US005179987A

United States Patent [19]

Mannato

[11] Patent Number: 5,179,987

[45] Date of Patent: Jan. 19, 1993

[54] BAG, HAND-BAG, AND ANY LIKE TRAVELLING BAG, WITH FOLDING BAG-CLOSING UPPER MEMBER

[75] Inventor: Pietro Mannato, Bologna, Italy

[73] Assignee: Finduck S.r.L., Bologna, Italy

[21] Appl. No.: 671,093

[22] Filed: Mar. 18, 1991

[30] Foreign Application Priority Data

Mar. 16, 1990 [IT] Italy ..... 3395 A/90

[51] Int. Cl.[5] ..... A45C 3/00; A45C 3/08; A45C 13/06; A45C 13/10

[52] U.S. Cl. ..... 150/118; 150/110; 190/114; 206/816

[58] Field of Search ..... 190/1, 4, 109, 103; 150/118, 107, 103, 110; 206/816; 220/252

[56] References Cited

U.S. PATENT DOCUMENTS

| | | | |
|---|---|---|---|
| 517,182 | 3/1894 | Willringhaus | 190/114 |
| 856,042 | 6/1907 | Duplessis | 190/103 |
| 975,898 | 11/1910 | Seward | 190/114 X |
| 1,938,519 | 12/1933 | Deffenbaugh | 220/252 X |
| 2,053,599 | 9/1936 | Brinkerhoff | 150/118 X |
| 2,105,550 | 1/1938 | Pilliod et al. | 206/816 X |
| 2,337,961 | 12/1943 | Arnold | 150/118 |
| 2,555,705 | 6/1951 | Schafer | 150/107 X |
| 2,606,652 | 8/1952 | Jaquette et al. | 206/816 X |
| 2,808,092 | 10/1957 | Green | 150/118 |

FOREIGN PATENT DOCUMENTS

| | | | |
|---|---|---|---|
| 47267 | 5/1933 | Denmark | 206/816 |
| 1109515 | 1/1956 | France | 150/118 |
| 2537855 | 6/1984 | France | 150/118 |
| 2743 | of 1858 | United Kingdom | 190/109 |

*Primary Examiner*—Sue A. Weaver

*Attorney, Agent, or Firm*—Pollock, Vande Sande & Priddy

[57] ABSTRACT

The bag is fitted at its top end portion with a substantially semi-cylindrical framework (a), with its arcuate part turned upwards, and with a shoulder strap or a handle (3) attached to rigid end sides (G1, G2) thereof. The bag body is fastened to the four lower side edges of the framework. The arcuate upper part of the framework is defined and closed by one or two flexible pieces (P1, P2) associated with the framework through rods (17, 117) and slat-like members (18, 118), and which are stretchable and foldable in a bellows-like manner, and are lockable in bag-closing position. To open the bag, the unclamped flexible pieces need only be drawn away from each other and folded bellows-like at the lower outward side ends of the framework.

5 Claims, 4 Drawing Sheets

BAG, HAND-BAG, AND ANY LIKE TRAVELLING BAG, WITH FOLDING BAG-CLOSING UPPER MEMBER

SUMMARY OF THE INVENTION

This invention relates to a bag, a hand-bag, or any like soft, rigid, or semiflexible travel bag, which at its top end portion is provided with bellows-like extensible-and foldable bag-closing means.

A bag of this type is fitted at its top end portion with a rigid, substantially semi-cylindrical framework that comprises two shield-shaped, substantially part-circular, parallel flat elements. The shield-shaped elements are fitted at opposite ends of the said framework, with their arcuate part being directed upwardly, and through stay rods are connected to each other at the corners of their lower side. The elements are each formed at their oppositely arranged inward faces, with curved guides which cooperate with the ends of an equal number of respective parallel rods that are fastened in equispaced parallel relation to the relative one of two flexible material pieces with their side end portions extending over the shield-shaped elements. These two flexible material pieces are each attached by one of their side edges to the respective one of the stay rods, and are each fitted at their other side edge which is opposite to the stay rod-attached side edge thereof, with a respective, slat-like flat member provided with a complementary bag-closing means. The two flexible material pieces are so provided that with the bag in closed condition, these pieces are stretched over the curved part of the framework and are locked together at the uppermost portion thereof, while with the bag in open condition, the flexible material pieces on the relative rods are each folded in bellows fashion at the respective, lower outward side end of the framework, so that access to the thus opened bag is possible. The bag body is partly attached to the stay rods for connection of the two shield-shaped elements, and partly to these shield-shaped elements.

BRIEF DESCRIPTION OF THE DRAWINGS

The features of the bag-closing means, and the advantages arising therefrom, will clearly appear in the following specification of one preferred embodiment of the same, which is shown by way of example in the attached drawings.

DESCRIPTION OF THE PREFERRED EMBODIMENT

Figure 1:
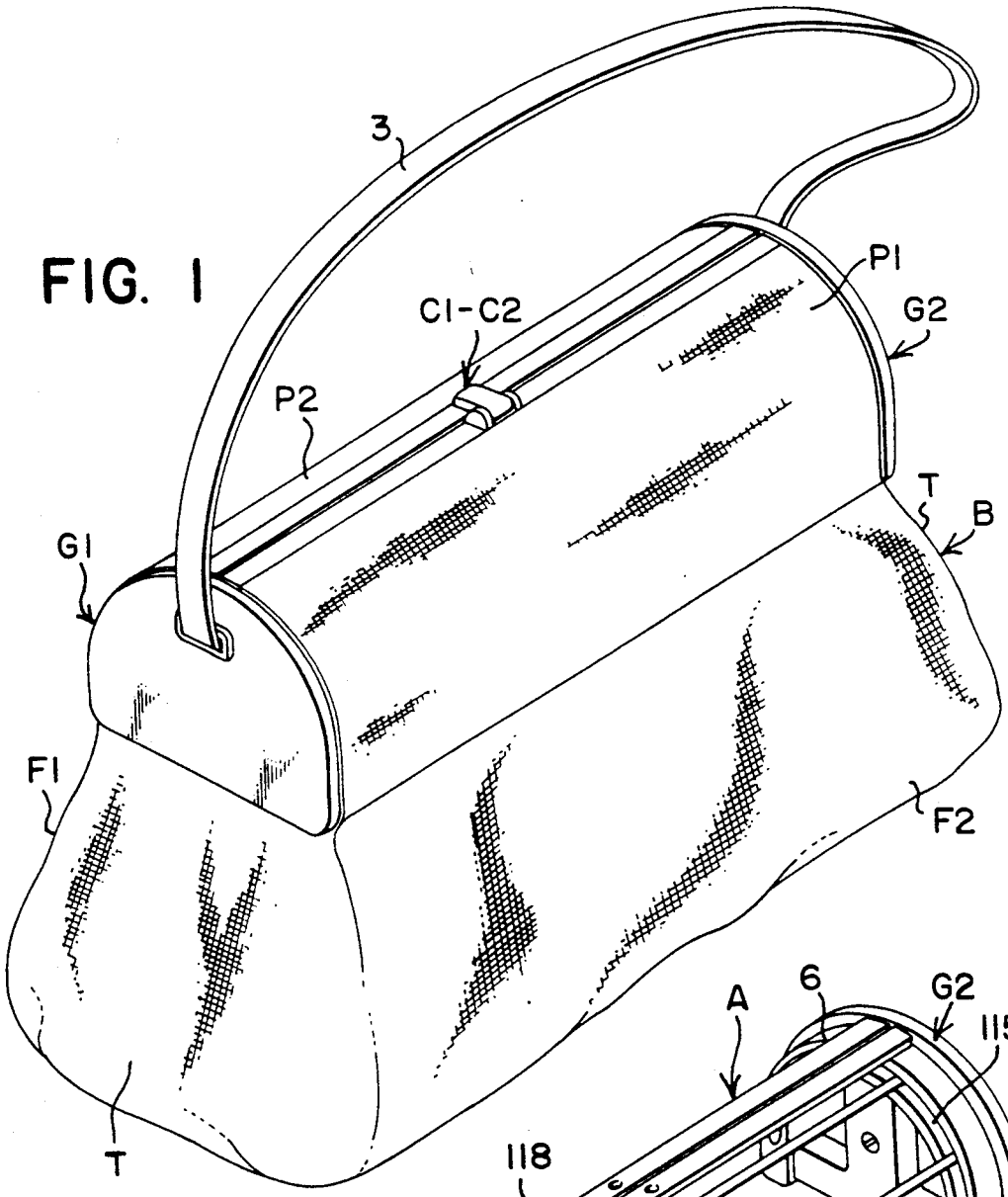
FIG. 1 is a perspective wiew of a bag according to the invention, shown in its closed condition.

Referring to the drawings, the bag B according to the invention is characterized by special bag-closing means at its top end portion, which comprise a framework A with a substantially part-circular, symmetrically equal, parallel, shield-shaped flat element G1, G2 at both of its ends, the straight side of the shield-shaped elements being situated at the bottom thereof.

Each shield-shaped element comprises an external cover member 1 preferably made of a suitably colored plastic material, and having a horizontal slot 2 in the median upper portion thereof, through which one end of the shoulder strap or handle 3 of the bag is to be passed. In intermediate positions, each cover member 1 is provided, on its side which is turned toward the internal bag part, with a pair of projections 4, 104 which are formed with a threaded blind hole, into which the screws 5, 105 for securing the said cover member to a respective plastic material plate 6 are screwed. The plate 6, which is made substantially like the cover member 1 (see hereinafter), has a box-like configuration which is open toward the cover member, and comprises an arcuate part 106 that is shaped like a horseshoe, and a part 206 that is shaped like an upturned T. Two holes 7, 107 are formed in the vertically extending section of each part 206, for the screws 5, 105 by which the plate 6 is secured to the cover member 1, to be passed therethrough, the shoulder strap 3 being simultaneously fastened by means of the screws 105 to the inside of the shield-shaped elements G1, G2. The lower side edges 8 of parts 206 are recessed from the ideal planes containing the outward faces of plates 6, so that an open space is provided at the bottom of the shield-shaped elements G1, G2, of such a width as to allow the upper edge portions T of the material forming the sides of the bag body, to be respectively passed therethrough. The said material upper edge portions are each attached to a respective transverse metal rod 9, having whose ends are fitted into recesses 10, 110 formed in the ends of the inward side edges of each arcuate part 106, and being held therein by the cover member 1.

Areas 11 and 111 may be closed or open areas.

The arcuate part 106 of each plate 6 has its inward face formed with recesses at the ends of its outward side edges, in which are fitted the ends of steel stay rods 12, 112, which are secured to the plates 6 by means of screws 13. When, as shown in the drawings, the heads of these screws protrude from the outward face of plates 6, the cover members 1 have their inward faces provided with matching recesses for receiving the said screw heads.

Figure 5:
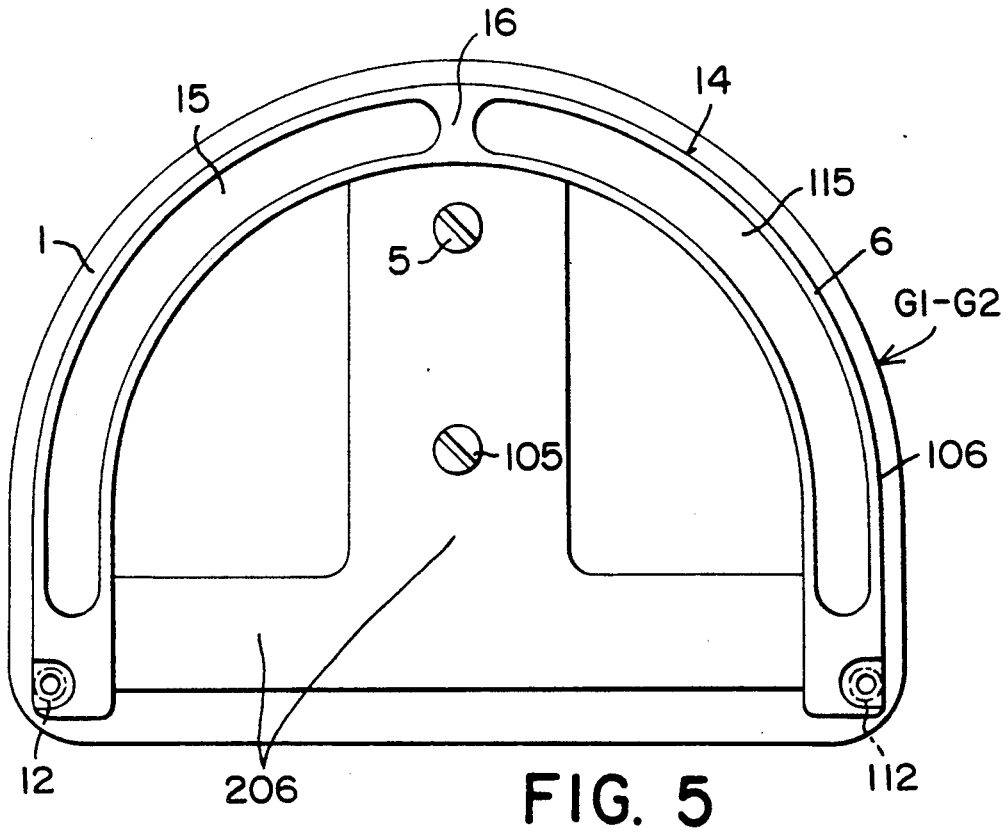
FIG. 5 is a view showing one of the shield-shaped elements forming the end sides of said framework, from its side which is turned toward the internal part of the bag.
Figure 6:
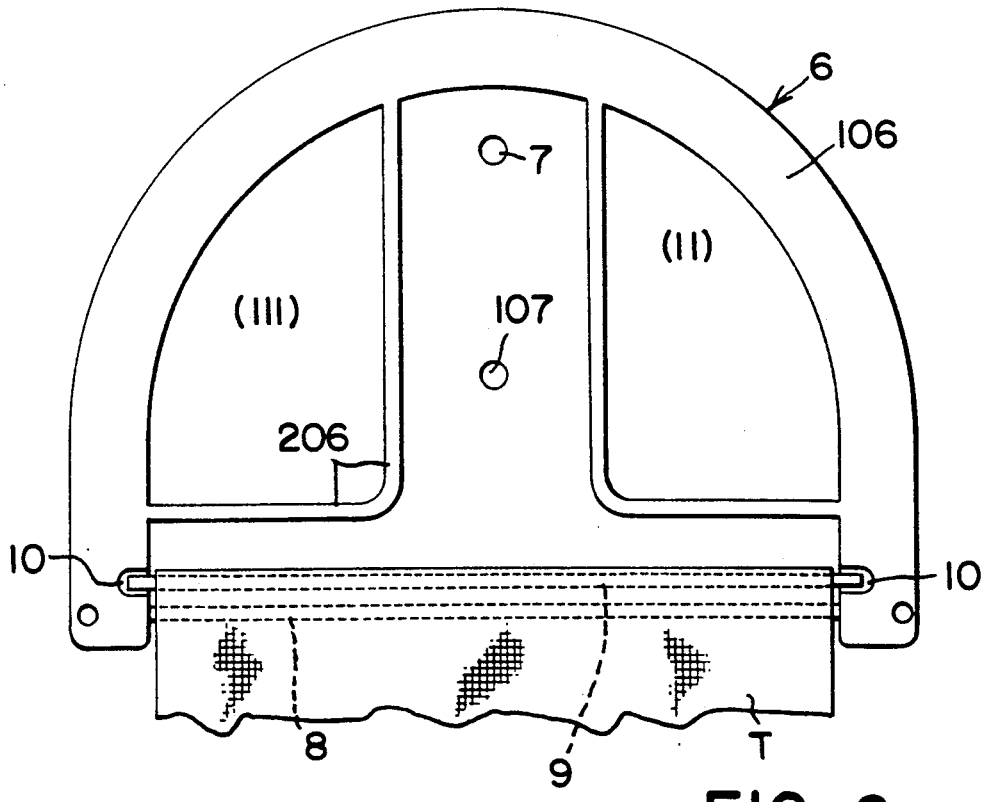
FIG. 6 is a view showing the internal component of one of the shield-shaped elements forming the end sides of said framework, from its side which is turned toward the external part of the bag.

As shown in FIG. 5, the arcuate parts 106 of plates 6 are each formed with a pair of identical curved grooves 15, 115 extending therealong, which are separated by an uppermost intermediate abutment member 16. The metallic rods 17, 117 which are round in cross-section, are fitted by their ends in the respective groove 15, 115, so as to be slidable therein, two of said rods being, for example, provided for each of the grooves.

Figure 2:
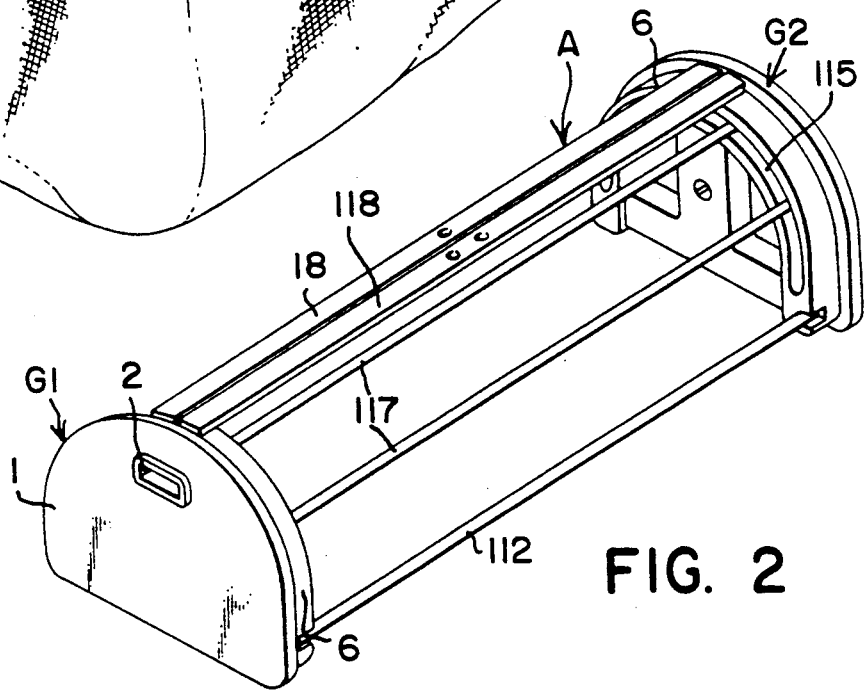
FIG. 2 is a perspective view showing in closed condition the framework for supporting the bellows-like extensible and foldable bag-closing means provided at the bag top end portion.
Figure 4:
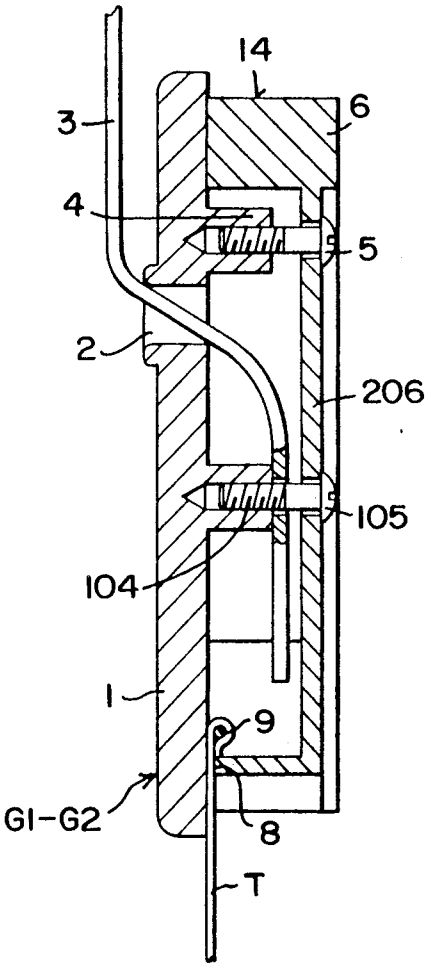
FIG. 4 is a cross-sectional view through one of the shield-shaped elements forming the end sides of the framework according to FIGS. 1 and 2.
Figure 3:
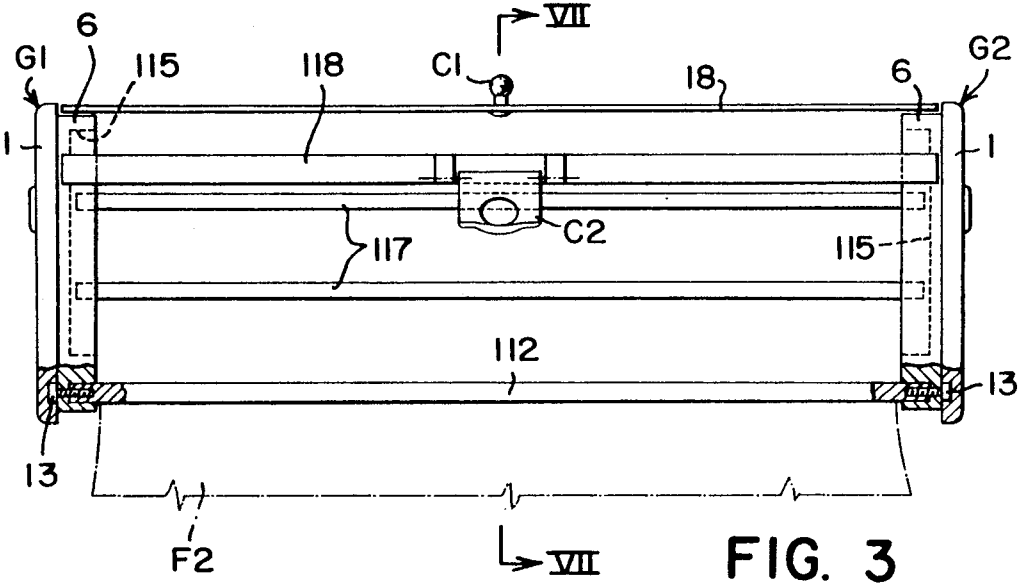
FIG. 3 is a side elevational view of the framework according to FIG. 2, with parts in section.
Figure 7:
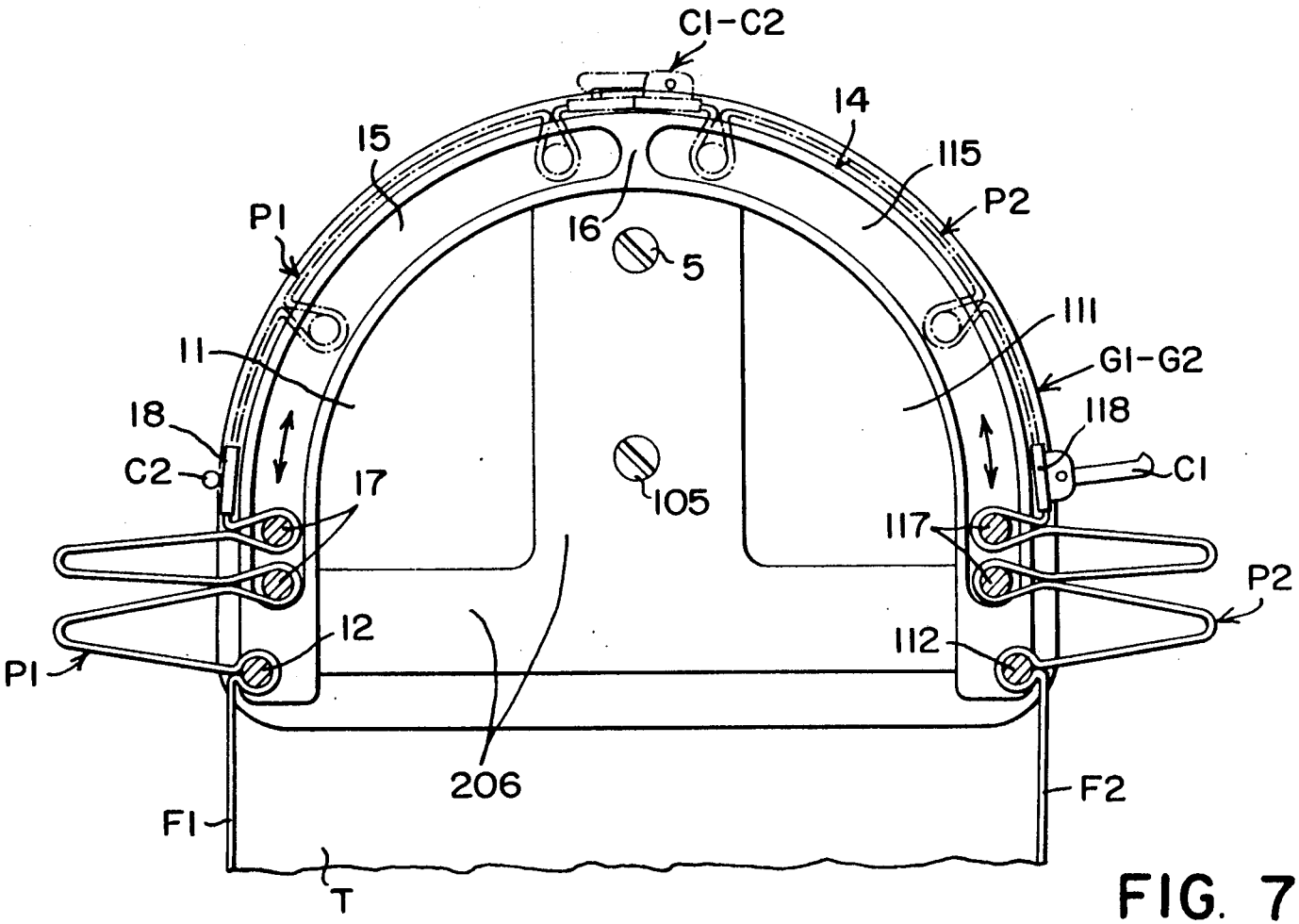
FIG. 7 is a cross-sectional view of the framework along line VII—VII of FIG. 3, with parts respectively set in the open position of the bag, and in the position for closing the bag.

As seen in FIGS. 2, 3, and 7, the cover member 1 is so sized as to be caused to protrude from the periphery of plate 6, so that a step 14 is formed by the said cover member with the outward face of said plate, which serves as a retaining and guide means for a pair of slat-like flat steel members 18, 118, to which the upper side edges of two flexible material pieces P1 and P2 are respectively attached, and the said pieces are made integral with the sides F1, F2 of the bag body, which in turn are firmly attached to the stay rods 12, 112, provided in the disclosed framework. The flexible material pieces P1 and P2 are fastened to the rods 17, 117 at equispaced intermediate portions thereof, and the last one of these round rods comes to be set near to the respective slat-like member 18, 118. The width of the said flexible material pieces P1 and P2 is such that by their side end portions the same extend over the arcuate parts 106 of plates 6, and are slidable on the above mentioned guides 14.

FIG. 7 shows that when the rods 17, 117 and the slat-like members 18, 118 are slid to the bottom end of the respective rod-guiding groove 15, 115, the flexible material pieces P1 and P2 are folded in a bellows-like manner at the outward lower side end of the respective part of framework A, so that the bag B has its top end in open condition. FIG. 7 shows in solid lines the open condition of the bag, and in dash lines the closed condition thereof, in which the said flexible material pieces are stretched on the respective part of framework A, with the flat slat-like members 18, 118 being set into mutual contact at the intermediate uppermost region of said framework, where complementary bag-closing means C1, C2 of any suitable type, which are preferably fixed in an intermediate position to the said slat-like flat members, can be clamped to each other so as to have the flexible material pieces held in bag-closing position.

It is to be understood that the specification refers to one preferred embodiment of the invention, to which numerous changes and modifications may be made. For example, only one bag-closing flexible material piece may be provided in place of the two bag-closing flexible material pieces. In this case, the guides 15, 115 are continuous guides, and are not fitted with the upper abutment member 16, and the bag-closing means C1, C2 are respectively fixed to the slidable slat-like member that is fastened to the free side edge of the flexible material piece and to the one stay rod 12 or 112 that is opposite to the other stay rod to which the said piece is firmly attached.

I claim:

1. A bag having an upper portion containing a rigid, curved framework (A) comprising first and second flat, parallel disk elements with a straight bottom edge and an arcuate, upwardly extending periphery connecting opposite corners of said straight bottom edge, said disk elements being disposed at opposite ends of said framework and transversely to said framework, said opposite corners being connected by stay rods, said disk elements having inwardly facing sides comprising arcuate guide tracks receiving opposite ends of equispaced parallel rods fastened to flexible material pieces having side portions extending longitudinally of said bag and end portions extending over said disk elements, said material pieces having lower edges attached to a respective one of said stay rods and upper edges fitted with at least one slat member provided with a bag-closing means, said material pieces being so disposed that, when said bag is in closed position, said material pieces are stretched over said curved framework and are locked together at an uppermost portion of said framework, and, when said bag is in open position, said material pieces are folded into bellows shape at lower, outwardly facing sides of said framework, a body portion of said bag being attached to said disk elements and to said stay rods.

2. The bag according to claim 1, wherein said disk elements each comprise an outer part constituting a cover member concealing attachment means for screwing an inner part comprising said tracks to said stay rods for connection to the inner part of the oppositely located disk element, said outer parts each having a median upper portion provided with a slot receiving opposite ends of bag carrying means, said ends being secured to inside portions of said disk elements.

3. The bag according to claim 2, wherein said inner parts of said disk elements comprise lower ends with inward side edges provided with recesses open toward said outer parts of said disk element, said recesses being adapted to receive ends of transverse rods, a side edge portion of said body portion of said bag being attached to one of said transverse rods, and being held in place by a respective outer part of said disk elements.

4. The bag according to claim 2, wherein said outer parts of said disk elements each comprise a peripheral projection from a respective inner part, whereby an L-profiled guide for retaining outward sides of said material pieces is formed with a respective lateral surface of said inner parts.

5. The bag according to claim 1, wherein said guide tracks are each formed by two substantially equal sections separated by an abutment means located in an uppermost region of each of said disk elements, said abutment means constituting a limit stop for a last one of said parallel rods for said material pieces, said material pieces being thus mutually locked in bag-closing position, against relative movement.

* * * * *